United States Patent [19]

Gralnik

[11] 4,118,948

[45] Oct. 10, 1978

[54] TWO PIECE FINGER RING

[76] Inventor: Sidney Gralnik, 4712 Cleveland St., Hollywood, Fla. 33021

[21] Appl. No.: 778,162

[22] Filed: Mar. 16, 1977

[51] Int. Cl.[2] ..... A44C 9/00

[52] U.S. Cl. ..... 63/15; 29/160.6

[58] Field of Search ..... 63/15; 29/160.6; 164/6, 164/9, 15

[56] References Cited

U.S. PATENT DOCUMENTS

| | | | |
|---|---|---|---|
| 1,842,427 | 1/1932 | Sammartino | 63/15 |
| 2,394,794 | 2/1946 | Manne | 63/15 |
| 2,712,173 | 7/1955 | Denner | 29/160.6 |
| 3,712,079 | 1/1973 | Eberle | 63/15 |

*Primary Examiner*—F. Barry Shay

*Attorney, Agent, or Firm*—Molin & Haley

[57] ABSTRACT

A finger ring comprised of two individually molded metal members, namely, a ring base and a ring cap joined together. The ring base is a molded circular band of metal which comprises the larger portion of the ring. The ring cap is a molded arcuate shaped metal member, slightly larger than a semi-circle which interlocks over the upper portion of the ring base. The bimetallic construction reduces the amount of precious metal required, thereby reducing the cost of construction without altering the aesthetic appearance or durability of the ring.

6 Claims, 4 Drawing Figures

TWO PIECE FINGER RING

BACKGROUND OF THE INVENTION

As is well known, prices of precious metals (most notably gold) have risen greatly in recent years. Industrial consumption of precious metals has increased in recent years, diminishing the available supply of certain metals. These factors have greatly increased the price of finger rings utilizing certain precious metals. In an effort to keep the price of finger rings down, ring manufacturers have tried various manufacturing techniques to reduce the volume of precious metal utilized.

Rings have been made of an inexpensive metal and then coated or "plated" with he desired precious metals. This method is undesirable because when the ring becomes scratched or worn, the underlying metal shows through.

Also, rings have been made completely of a precious metal but molded in such a way that the ring band is hollow. This method is undesirable because there is an obvious weight difference between such a hollow ring and a genuninely solid precious metal ring.

Further, a ring can be made as described above with the addition of an inexpensive metal to the hollow part of the ring. This method is desirable in that scratches ad wearing away of the surface will not expose the underlying metal. However, this method is undesirable in that a major part of the ring is still composed of the precious metal; thus the ring is nearly as expensive as the solid precious metal ring.

The present invention provides a finger ring which has an outer, upper surface covered wth a precious metal so that the ring appears to be composed entirely of the precious metal, with the outer cap of precious metal being sufficiently thick that the normal wearing and scratching, even over a long period of time, will not expose the underlying metal. In the present invention, the cap is molded to conform to the molded surface of the ring base such that cap and base interlock perfectly.

BRIEF SUMMARY OF THE INVENTION

A fnger ring used as an article of jewelry or the like comprising two individually molded members of different metals joined to form a unitary ring. One member, which serves as the ring base is a molded, circular band of metal having an annular finger receiving passage. The other member, a ring cap, is a molded arcuately shaped metal segment, formed of the precious metal, the arcuate segment being slightly larger than a semi-circle. The ring base and ring cap are individually molded and sized to interlock together, with the cap overlaying substantially the upper one-half of the ring base. The ring base is composed of a metal which is a less precious metal than that used for the ring cap. To an observer the ring appears to be composed entirely of the more expensive metal used in the cap. The ring base includes supporting lips on each exterior side for mounting the ring cap thereon.

Once the ring base has been molded, its exterior upper surface is used to make the mold which forms the interior, engaging surface of the cap. By doing this, one obtains a ring cap which has an interior contour surface exactly fitted to the exterior contour of the ring base. Since the exterior surface of the ring base was used to make the mold for the interior surface of the cap, any irregularity in the exterior surface of the ring base will also appear on the interior surface of the cap, thus ensuring that the cap will fit precisely over the ring base. The exterior surface of the cap may be covered with whatever engravings or designs are desired. For additional bonding, the cap is soldered to the base. The ring cap is slightly larger than the semi-circular size of the base for a biased fitting of the cap to the base.

It is an object of this invention to produce a ring which aesthetically appears to be composed of one precious metal while actually being composed largely of another less expensive metal.

It is another object of this invention to produce a ring which has the same approximate weight as a ring which is completely and solidly composed of one precious metal.

And yet still another object of this invention is to produce a ring which is much less expensive than a ring composed solidly of one precious metal, reducing the consumption of precious metals.

A further object of this invention is to provide a unitary ring composed of two separate pieces which interlock structurally for a superior fit.

An additional object of this invention is to produce a ring which is structurally stronger than a ring composed completely of a soft metal such as gold.

In accordance with these and other objects which will be apparent hereinafter, the instant invention will now be described with particular reference to the accompanying drawings.

PREFERRED EMBODIMENT OF THE INVENTION

Before the present finger ring is specifically described, it is to be understood that the invention is not limited to the particular arrangement of the parts here shown, as such rings may vary. It is also to be understood that the phraseology or terminology herein used is for purposes of description of particular embodiments and not of limitation, as the scope of the present invention is denoted by the appended claims.

Figure 2:
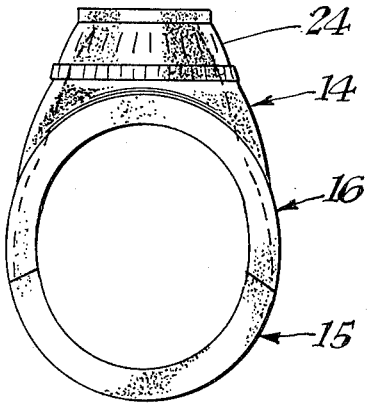
FIG. 2 is an illustration of a side elevational view of the invention with the cap in place on the ring base.
Figure 1:
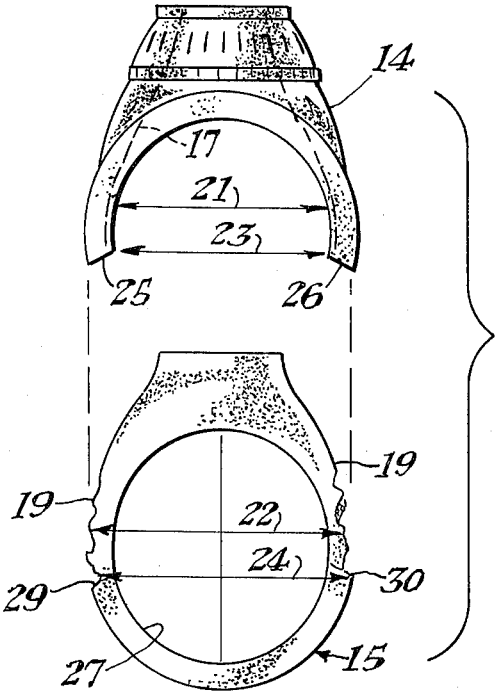
FIG. 1 is an illustration of a side elevational, exploded view of the invention, with the cap and ring base separated.

Referring now to FIGS. 1 and 2, the ring 16, in accordance with one embodiment of the invention, is comprised of a performed cap 14 that is molded to interlock on the upper portion of the performed ring base 15. When the cap 14 is pressed downward toward the ring base 15 (FIG. 1), the two members 14 and 15 snap together as shown in FIG. 2. Solder for bonding is injected around the seam formed by joining the cap and base and between cap 14 and base 15. The solder is smoothed by buffing and polishing.

Figure 3:
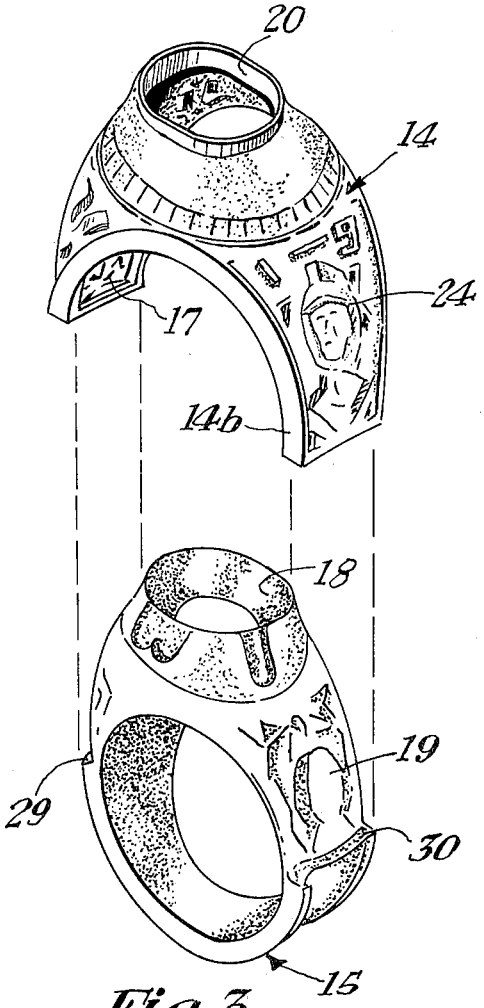
FIG. 3 is an enlarged perspective of a exploded view of the invention, with the cap and ring base separated.

Referring now to FIG. 3, the inner surface 17 of the ring cap 14 is formed from a mold which was back molded using the outer, upper surface 19 of the ring base 15, the base surface 19 being of a shape to be exactly fitted to the surface 17. The interior diameter 21 of the cap 14 (FIG. 1) is precisely equal to the exterior diameter 22 of the ring base 15. The cap 14 constitutes an arcuate metal member somewhat larger than a semi-circle (greater than 180°) having end faces 25 and 26. The distance 23 from cap end 25 to end 26 is smaller than the diameter 21 but is precisely equal to the distance 24 between ring base lips 29 and 30. Thus in order to place the ring cap 14 over the ring base 15 a small amount of force must be applied resiliently spreading the ring cap ends 25 and 26 apart. When the cap 14 is forced over the ring base 15, the chord 23 is temporarily expanded but when the surfaces 19 and 17 are in contact, the resilience of the cap 14 causes the chord distance between the ends 25 and 26 to return to its original length 23, holding the cap 14 firmly to base 15.

The diameter of the ring finger receiving aperture 27 in ring base 15 can be varied independently of the outer diameter 22 simply by varying the thickness of the ring base 15.

When the ring cap 14 is in place on the ring base 15, the interior surface 17 of the cap is contoured to interlock to the exterior surface 19 of the ring base while the ends 25 and 26 of the ring cap 14 are supported and interlocked on lips 29 and 30 of the ring base.

When the cap is in place on the ring base as just described, solder is injected between the cap and ring base so that the cap is soldered or otherwise permanently affixed to the ring base. The contact seam is filled with solder and buffed so as to make a smooth undetected junction.

As an alternative to making the base and then using it to make a mold for the cap, the cap may be made initially and its inner surface used to make a mold to form the upper surface of the base.

As seen from FIG. 3, the ring base 15 has a much greater volume than the cap 14. In one embodiment, the ring cap is composed of a precious metal (such as gold) whereas the ring base is composed of a less expensive metal. However, when the cap 14 is in place on the ring base 15 and the ring is on the wearer's finger, only the cap is visible. Also, a gem may be mounted in the ring base aperture 18 and cap aperture 20. Various designs, contours and engravings may be placed on the cap upper exterior surface 24.

It should be noted that this invention is most applicable to military and school type rings which have wide thick bands requiring large amounts of precious metals to make.

Figure 4:
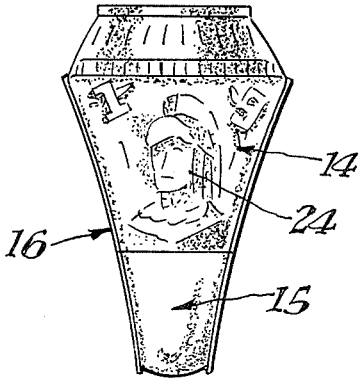
FIG. 4 is a side elevational view of the instant invention with ring cap and ring base joined.

FIG. 4 shows a side view of the ring with cap and ring base joined.

A hill and dale or other irregular surface pattern on the interior surface 17 of cap 14 acts to enhance the interlocking characteristics of cap and base since one surface serves as the back mold of the other surface, insuring a perfect fit each time.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A finger ring comprising:

a preformed ring base, said base being a molded, closed circular band of metal having an upper portion with an exterior surface of a particular contour; and a preformed ring cap, said cap being a molded, arcuate segment of metal having an interior surface closely fitting said contour of said exterior surface, said base and cap molded to interlock with each other.

2. A ring as defined in claim 1 wherein:

said ring cap was made from a mold formed by using the ring base.

3. A ring as defined in claim 2 wherein:

said ring cap is composed of gold and said ring base is composed of silver.

4. A ring as in claim 1, wherein:

said ring base includes a lip on each side of said band protruding outwardly, said cap having end faces which engage said base lips when said base and cap are interlocked.

5. A ring as in claim 1, including:

said cap having a lower irregular surface, and said ring base having an upper irregular surface molded from the irregular surface of said cap.

6. A ring as in claim 5, including:

a bonding means disposed between said cap and base.

* * * * *